United States Patent [19]

Sando et al.

[11] 4,364,248

[45] Dec. 21, 1982

[54] METHOD AND APPARATUS FOR WET-HEAT TREATING A KNITTED FABRIC

[75] Inventors: Yoshikazu Sando; Hiroshi Ishidoshiro, both of Wakayama, Japan

[73] Assignee: Sando Iron Works Co., Ltd., Wakayama, Japan

[21] Appl. No.: 236,014

[22] Filed: Feb. 19, 1981

[30] Foreign Application Priority Data

Feb. 20, 1980 [JP] Japan ..... 55-19969
Feb. 20, 1980 [JP] Japan ..... 55-19970

[51] Int. Cl.[3] ..... D06B 21/02
[52] U.S. Cl. ..... 68/5 E
[58] Field of Search ..... 68/5 D, 5 E, 205 R

[56] References Cited

U.S. PATENT DOCUMENTS

| | | | |
|---|---|---|---|
| 1,818,041 | 8/1931 | Chapin | 68/5 D |
| 2,443,990 | 6/1948 | O'Keeffe | 68/5 E |
| 3,579,679 | 5/1971 | Willis | 68/205 R X |
| 4,182,143 | 1/1980 | Sando et al. | 68/5 E |

*Primary Examiner*—Philip R. Coe
*Attorney, Agent, or Firm*—Toren, McGeady & Stanger

[57] ABSTRACT

For wet-heat treating a knitted fabric in a high pressure steamer, a knitted fabric is subjected alternately and repeatedly to a soaking process with a treating solution to permeate the treating solution in the fabric under pressure and to a steaming process of the fabric while transporting the fabric continuously through the steamer body under no tension. The knitted fabric is soaked with the treating solution uniformly and sufficiently up to the interior thereof, so that the treatment of a knitted cloth can be done uniformly to produce a product with excellent quality.

3 Claims, 2 Drawing Figures

METHOD AND APPARATUS FOR WET-HEAT TREATING A KNITTED FABRIC

BACKGROUND OF THE INVENTION

The present invention relates to an apparatus for wet-heat treating a knitted fabric, particularly a cylindrical one, continuously in a high pressure steamer for subjecting the fabric to such treatments as pre-treatment and dyeing. By wet-heat treatment of a textile material is meant steaming a textile material soaked with a pre-treating solution such as a caustic alkali solution for pre-treatment or soaked with a dye solution for dyeing under wet-heat at high temperature and pressure.

For wet-heat treating a cylindrical knitted fabric, it has conventionally been adopted such method as to soak a cylindrical knitted fabric to be treated with a treating solution (such as a caustic alkali solution for pre-treatment and a dye solution for dyeing) and to wet-heat treat the resultant fabric in a reaction tower or in a steamer maintained with a sufficiently high temperature wet-heat, or to transport a cylindrical knitted fabric through a treating solution stored in a liquid tank provided in a steamer body and to wet-heat treat the fabric in the said steamer body. In such a method, however, since a cylindrical knitted fabric is soaked only one time with the treating solution, the treating solution can with difficultly penetrate into the core part of the fabric particularly when the fabric is composed of thick and voluminous, yarn and consequently, the fabric cannot be treated uniformly leaving unreacted parts to deteriorate the commodity value of the treated fabric. Furthermore, while the treating solution has conventionally been applied outside of the steamer, uniform treatment of a fabric can with difficulty be done owing to the fluctuation of the amount of the treating solution applied to the fabric due to the change of the atmospheric temperature.

In wet-heat treating a cylindrical knitted fabric by transporting a fabric through a steamer continuously, it has conventionally been adopted to provide a plurality of guide rolls for passing the fabric up and down zigzag in the steamer body in order to prolong the treating time or the stay period of the fabric in the steamer body. However, the interval (or head) between the two guide rolls provided up and down must be tolerably large to guide a fabric effectively, so that a tension is applied unavoidably to the fabric due to its own weight containing a large amount of the treating solution causing such troubles that the cylindrical knitted fabric is elongated and the amount of the treating solution becomes poor at both sides of the fabric. From this point, too, uniform and satisfactory treatment of a cylindrical knitted fabric can hardly be done.

SUMMARY OF THE INVENTION

Under such circumstances, the object of the present invention is to offer an apparatus for wet-heat treating a knitted fabric, particularly a cylindrical one, continuously in a high pressure steamer by eliminating such drawbacks as above-mentioned.

The gist of using the present inventive appartus is to transport a knitted fabric to be treated through a plurality of driving rolls provided up and down zigzag under no tension in a steamer body while subjecting the fabric alternately and repeatedly to a soaking process to permeate a treating solution to the fabric up to the core part thereof and to a process of steaming the fabric.

Since the treating solution is applied fractionally and repeatedly to the fabric, the fabric is soaked with the treating solution uniformly and sufficiently, and the treatment of a knitted fabric can be done uniformly under no tension to produce an excellent product continuously.

DESCRIPTION OF THE PREFERRED EMBODIMENTS

Figure 1:
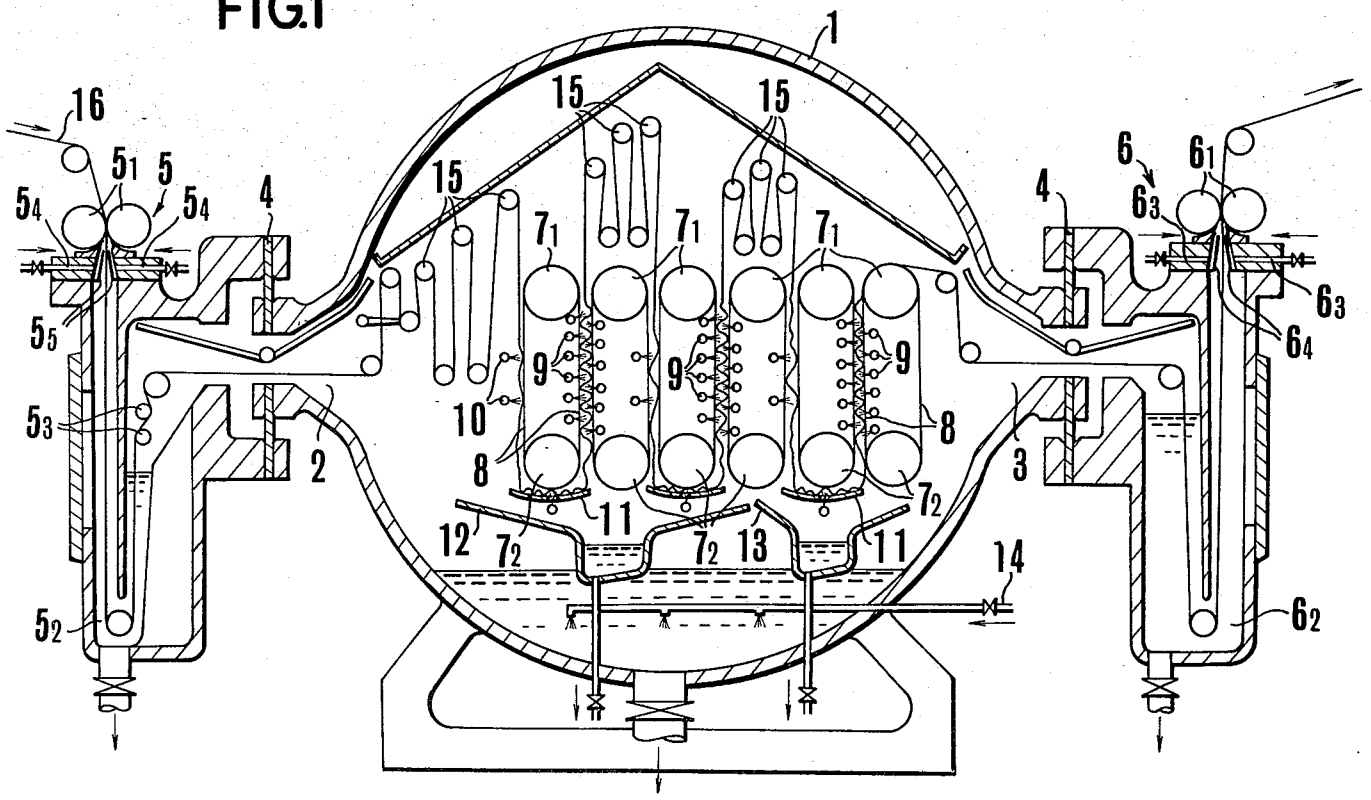
FIG. 1 is a sectional diagram of an example of the present inventive apparatus.

In FIG. 1, 1 is a steamer body, 2 is a fabric inlet attached to the steamer body 1, and 3 is a fabric outlet attached thereto. To each of the fabric inlet and outlet, a packing 4 for releasing the strain of the steamer body, and an inlet side seal mechanism 5 and an outlet side seal mechanism 6 are provided. These seal mechanisms 5 and 6 are provided for allowing the inlet and outlet of the fabric by maintaining the wet heat in the steamer body at higher temperatures without leakage. The inlet side seal mechanism 5 comprises a pair of seal rubber rolls s, pressed against one another a nearly J-shaped liquid seal tank $5_2$ provided inwardly of the seal rubber rolls $5_1$, and squeeze bars $5_3$ for squeezing the fabric coming from the liquid seal tank $5_2$. $5_4$ is a liquid supply pipe for supplying a treating solution to the liquid seal tank $5_2$, and $5_5$ is a guide wall provided for the purpose to contact the treating solution coming from the liquid supply pipe $5_4$ firstly to the seal rubber rolls $5_1$ to cool the rolls and then to flow the treating solution into the liquid seal tank $5_2$. The outlet side seal mechanism 6 comprises a pair of seal rubber rolls $6_1$ and a nearly J-shaped cooling liquid tank $6_2$. $6_3$ is a liquid supply pipe for supplying a liquid for slow cooling and washing the fabric, and $6_4$ is a guide wall provided for the purpose to contact the liquid coming from the liquid supply pipe $6_3$ to the seal rubber rolls $6_1$ to cool the rolls and then to flow the liquid into the slow cooling liquid tank $6_2$.

$7_1$ and $7_2$ are a pair of driving rolls provided up and down in parallel in the steamer body 1, and a plurality of sets of driving rolls are arranged in the horizontal direction. 8 is a permeable net conveyer provided around a pair of driving rolls $7_1$ and $7_2$. A gap between the adjacent net conveyers is to serve as a fabric passage for transporting the fabric continuously therethrough. A plurality of liquid jet nozzles 9*a* provided zigzag along the net conveyers 8 for jetting a treating solution to the fabric going upwardly through the fabric passage in order to permeate the treating solution up to the core part of the fabric sufficiently. Under circumstances, washing water may be jetted to the fabric at the latter part of the fabric passage. 10 are steam jet nozzles for jetting steam to the fabric going downwardly along the net conveyer 8 for the purpose to contact the fabric to the net conveyer and to steam the fabric.

Figure 2:
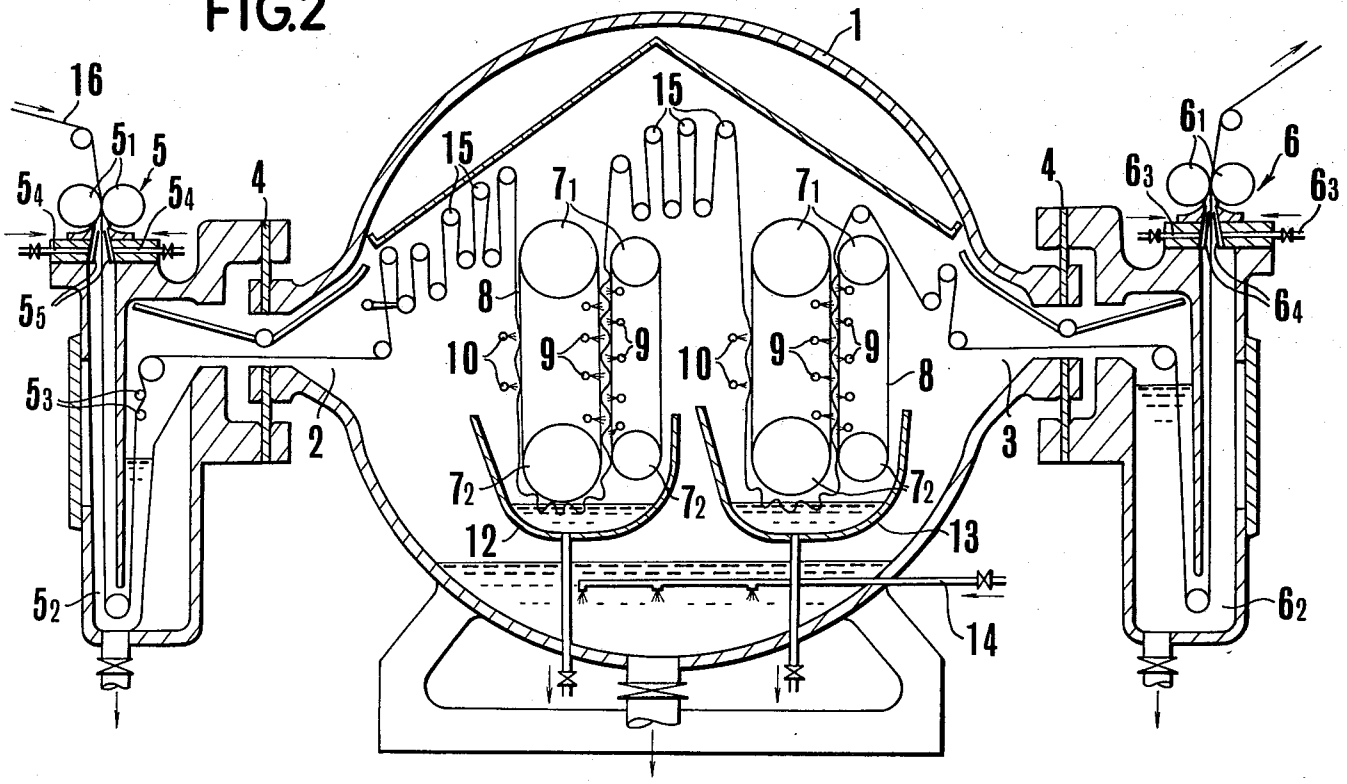
FIG. 2 is the same of a modification of the apparatus shown in FIG. 1.

11 is a fabric saucer to U-turn the fabric forming snaky undulations in passing the fabric around the lower driving roll $7_2$, 12 is a treating solution receptacle, and 13 is a treating solution or a washing water receptacle. Under circumstances, the fabric saucer 11 may be dispensed with. In another instance, as shown in FIG. 2, the fabric in this part may be immersed in the treating solution and/or washing liquid receptacles 12 and 13 for supplying the treating solution sufficiently to the fabric and/or washing the fabric.

14 is a steam pipe for blowing steam in the steamer body to maintain the wet heat therein sufficiently, 15 are a plurality of guide rolls for steaming the fabric, and 16 is a knitted fabric to be treated.

Continuous wet-heat treatment of a knitted fabric by using the apparatus in FIG. 1 is done, for instance, as follows.

A prescribed treating solution (for example, a caustic alkali solution for pretreatment and a dye solution for dyeing) is supplied from the liquid supply pipe $5_4$ to the liquid seal tank $5_2$ to fill up the liquid seal tank, cooling water is supplied successively from the liquid supply pipe $6_3$ to the slow cooling liquid tank $6_2$, and the interior of the steamer body 1 is maintained with a wet heat at a high temperature above 100° C. Then, a knitted fabric to be treated, 16, is supplied to the steamer body through the inlet side seal mechanism 5 while soaking the fabric with the treating solution in the liquid seal tank $5_2$, and the fabric is steamed in passing over the guide rolls 15.

The fabric is shortly going down along the net conveyer 8 while jetting steam from the steam jet nozzles 10 to the fabric to steam the fabric further. Since the fabric is pressed to the net conveyer due to the jetting force of the steam, the fabric receives no weight of its own and goes downwardly under no tension. The fabric is then mounted on the first fabric saucer 11, where the fabric is U-turned forming snaky undulations, and transported upwardly through the fabric passage formed between the two adjacent net conveyers 8 due to the rotation of the driving rolls $7_1$ and $7_2$ while jetting the treating solution from the liquid jet nozzles 9 zigzag to the fabric. The fabric goes under no tension forming snaky undulations and is soaked with the treating solution up to the core part thereof effectively. The fabric pulled up to the end of the fabric passage is steamed while passing through the next group of the guide rolls 15, and goes downwardly through the next fabric passage, where steam is jetted to the fabric from the steam jet nozzles 10 for renewed steaming. The fabric goes downwardly under no tension as in the preceding instance. The soaking of the treating solution to the fabric and the steaming of the fabric is repeated in this way while the fabric is transported under no tension.

The latter part of the process may be utilized for the preliminary washing of the treated fabric by jetting washing water from the liquid jet nozzles 9. The fabric is then cooled in passing through the slow cooling tank $6_2$, and is taken out from the steamer.

In case when the apparatus shown in FIG. 2 is employed, the fabric coming from the first guide rolls is immersed in the treating solution in the treating solution receptacle 12 for securing the sufficient application of the treating solution to the fabric, and the receptacle 13 may similarly be utilized for the preliminary washing of the treated fabric.

As above explained, the present inventive apparatus for wet-heat treating a knitted fabric comprises providing, in a steamer body maintained with a high temperature wet heat, a plurality of endless net conveyers vertically in parallel forming a fabric passage therebetween for transporting a knitted fabric up and down forming snaky undulations through the fabric passage under no tension, a plurality of liquid jet nozzles for jetting a treating solution to both sides of the net conveyers zigzag alternatively in ascending the fabric through the fabric passage, and a number of steam jet nozzles for jetting high temperature steam to one side of the net conveyer in descending the fabric through the fabric passage. Therefore, a knitted fabric supplied to the steamer body is soaked with a treating solution such as a pretreating solution or a dye solution repeatedly under pressure, so that the treating solution can uniformly and sufficiently be applied to the fabric up to the core part thereof, and consequently the wet-heat treatment of a fabric is done uniformly to produce a product with an excellent quality. In utilizing the latter part of the apparatus for jetting washing water from the liquid jet nozzles by providing a washing water receptacle, the preliminary washing of the treated fabric can similarly be done efficiently.

Furthermore, in immersing the fabric in a treating solution in a treating solution receptacle provided below the lower driving rolls prior to the jetting of the treating solution to the fabric, the fabric is swelled and soaked more sufficiently with the treating solution. Since the wet-heat treatment of a knitted fabric is done under no tension in the present invention, the invention has such merit that a uniform wet-heat treatment of the fabric can be done continuously with no formation of such drawbacks as unevenness, crease mark and elongation.

It goes without saying that the present invention may be applied also for the wet-heat treatment of a woven fabric.

What is claimed is:

1. An apparatus for wet-heat treating a knitted fabric in a high pressure steamer, comprising providing, in a steamer body maintained with a high temperature wet heat, a plurality of endless net conveyers extending vertically in spaced parallel relation and each said conveyer rotatable respectively by means of a pair of driving rolls spaced one above the other with adjacent said conveyers forming a fabric passage therebetween for transporting a knitted fabric in one of the up and down directions and forming snaky undulations through the fabric passage under no tension, a plurality of liquid jet nozzles for jetting one of a treating solution and washing water through both sides of the net conveyers forming at least one of the fabric passages, and a number of steam jet nozzles for jetting high temperature steam toward one side of at least one of the net conveyers spaced from the side through which the one of the treating solution and washing water is jetted for steaming the fabric more sufficiently.

2. An apparatus for wet-heat treating a knitted fabric set forth in claim 1, in which a fabric saucer is provided below the lower side driving roll for U-turning the fabric under no tension forming snaky undulations.

3. An apparatus for wet-heat treating a knitted fabric set forth in claim 1, in which a liquid receptacle is provided below the lower side driving roll for immersing the fabric in the treating solution and or washing water in U-turning the fabric.

* * * * *